US012084751B2

(12) United States Patent
Xue et al.

(10) Patent No.: US 12,084,751 B2
(45) Date of Patent: Sep. 10, 2024

(54) METHOD FOR MANUFACTURING COLD-ROLLED OR ZINC-PLATED DUAL-PHASE STEEL PLATE OVER 980 MPA

(71) Applicant: BAOSHAN IRON & STEEL CO., LTD., Shanghai (CN)

(72) Inventors: Peng Xue, Shanghai (CN); Li Wang, Shanghai (CN); Xiaodong Zhu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 853 days.

(21) Appl. No.: 17/252,031

(22) PCT Filed: Jun. 14, 2019

(86) PCT No.: PCT/CN2019/091202
§ 371 (c)(1),
(2) Date: Dec. 14, 2020

(87) PCT Pub. No.: WO2019/242565
PCT Pub. Date: Dec. 26, 2019

(65) Prior Publication Data

US 2021/0254200 A1 Aug. 19, 2021

(30) Foreign Application Priority Data

Jun. 19, 2018 (CN) ..... 201810631925.4

(51) Int. Cl.
*C22C 38/14* (2006.01)
*C21D 8/02* (2006.01)
(Continued)

(52) U.S. Cl.
CPC ..... *C22C 38/14* (2013.01); *C21D 8/0205* (2013.01); *C21D 8/0226* (2013.01);
(Continued)

(58) Field of Classification Search
None
See application file for complete search history.

(56) References Cited

FOREIGN PATENT DOCUMENTS

CN 105803321 A 7/2016
CN 107043888 A 8/2017
(Continued)

OTHER PUBLICATIONS

English language machine translation of JP-04289120-A. Generated Jan. 23, 2024. (Year: 2024).*
(Continued)

*Primary Examiner* — Brian D Walck
(74) *Attorney, Agent, or Firm* — Lei Fang, Esq.; Smith Tempel Blaha LLC

(57) ABSTRACT

The present invention provides a method for manufacturing a cold-rolled or zinc-plated dual-phase steel plate over 980 MPa. After being subjected to hot rolling, coiling, bundling, and online heat preservation, a slab is directly sent to a cold rolling and continuous annealing process, or a cold rolling, continuous annealing, and zinc plating process, so as to obtain a cold-rolled or zinc-plated dual-phase steel plate, wherein the coiling temperature is controlled to be over 450° C. The online thermal preservation means that after uncoiling of each hot-rolled coil, an independent and airtight thermal preservation cover is closed, and the hot-rolled coil with the closed thermal preservation cover is transferred to coil rolling by means of a steel coil conveying chain or a traveling car; the thermal preservation temperature for the hot-rolled coil in the thermal preservation cover is over 450° C., and the thermal preservation duration is less than 20 hours. According to the present disclosure, by means of the design of a thermal preservation process with or without a heat source after hot rolling and coiling, the manufacturing problems such as edge cracks and sharp fluctuation in
(Continued)

thickness after cold rolling are solved, and good cold rolling manufacturability is achieved.

13 Claims, 5 Drawing Sheets

(51) Int. Cl.

| | |
|---|---|
| ***C21D 9/46*** | (2006.01) |
| ***C21D 9/68*** | (2006.01) |
| ***C21D 11/00*** | (2006.01) |
| ***C22C 38/02*** | (2006.01) |
| ***C22C 38/04*** | (2006.01) |
| ***C22C 38/06*** | (2006.01) |
| ***C23C 2/00*** | (2006.01) |
| ***C23C 2/02*** | (2006.01) |
| ***C23C 2/06*** | (2006.01) |
| ***C23C 2/20*** | (2006.01) |

(52) U.S. Cl.

CPC ..... *C21D 8/0236* (2013.01); *C21D 9/46* (2013.01); *C21D 9/68* (2013.01); *C21D 11/00* (2013.01); *C22C 38/02* (2013.01); *C22C 38/04* (2013.01); *C22C 38/06* (2013.01); *C23C 2/0038* (2022.08); *C23C 2/02* (2013.01); *C23C 2/022* (2022.08); *C23C 2/06* (2013.01); *C23C 2/20* (2013.01); *C21D 2211/002* (2013.01)

(56) References Cited

FOREIGN PATENT DOCUMENTS

| | | | | |
|---|---|---|---|---|
| CN | 107470377 | A | | 12/2017 |
| CN | 207170521 | U | | 4/2018 |
| EP | 0922782 | A1 | | 6/1999 |
| JP | 04289120 | A | * | 10/1992 |
| JP | H11716345 | A | | 3/1999 |
| JP | 2016-511148 | A | | 4/2016 |

OTHER PUBLICATIONS

English language machine translation of CN 107470377 A . Generated Jan. 23, 2024. (Year: 2024).*

English language machine translation of CN 105568145A. Generated Jan. 23, 2024. (Year: 2024).*

"Batch Hot Dip Galvanized Coatings." ASM Handbook, vol. 5: Surface Engineering. C.M. Cotell, J.A. Sprague, and F.A. Smidt, Jr. editors, p. 360-371. 1994. (Year: 1994).*

International Search Report mailed on Aug. 21, 2019 for PCT Patent Application No. PCT/CN2019/091202.

Written Opinion mailed on Aug. 21, 2019 for PCT Patent Application No. PCT/CN2019/091202.

OA from JP Patent Office for App No. 2020-570147.

* cited by examiner

METHOD FOR MANUFACTURING COLD-ROLLED OR ZINC-PLATED DUAL-PHASE STEEL PLATE OVER 980 MPA

CROSS-REFERENCE TO RELATED APPLICATIONS

This application is a 371 U.S. National Phase of PCT International Application No. PCT/CN2019/091202 filed on Jun. 14, 2019, which claims benefit and priority to Chinese patent application no. CN 201810631925.4 filed on Jun. 19, 2018, the contents of both are incorporated by reference herein in their entiries.

TECHNICAL FIELD

The invention relates to a method for manufacturing an ultra-high-strength steel plate, in particular to a method for manufacturing a cold-rolled or galvanized dual-phase steel plate having a strength of at least 980 MPa.

BACKGROUND ART

Because cold-rolled or galvanized dual-phase ultra-high-strength steel (at least 980 MPa) strengthened mainly via phase transformation has a high content of alloying elements and strong hardenability, after an intermediate hot rolling process, the structure and properties of this material is extremely sensitive to variation of a temperature change process after hot rolling and coiling. In a traditional hot rolling process, only temperatures before coiling, such as tapping temperature, final rolling temperature, and coiling temperature, are controlled precisely. There is no fine control over temperature change after coiling.

The non-uniformity of cooling rate—structure—properties of different parts of a steel coil generated during a cooling process of the steel coil will have a significant adverse effect on the cold-rolling manufacturability of the ultra-high-strength hot steel coil. The different cooling histories of the different parts of the steel coil in the cooling process after stacked are fundamentally responsible for such an adverse effect.

Taking a cold-rolled ultra-high-strength dual-phase steel having a strength of at least 980 MPa as an example: after hot-rolling and coiling, the bainite region is relatively wide, and the critical cooling rate of martensite is high. After the coiling, the region having a high cooling rate extends to the bainite or even martensite phase transformation zone. The structure in the other region having a low cooling rate is dominated by pearlite. As a result, the structure and strength after the coiling are not uniform, and this leads to production problems such as sharp fluctuations in thickness after cold rolling, edge cracking after cold rolling, and so on.

SUMMARY

One object of the present disclosure is to provide a method for manufacturing a cold-rolled or galvanized dual-phase steel plate having a strength of at least 980 MPa, wherein a thermal insulating process with or without a heat source after hot rolling and coiling is designed to solve the problems of edge cracking after cold rolling, sharp thickness fluctuation after cold rolling and the like that occur in manufacturing, so as to obtain good cold-rolling manufacturability.

In order to achieve the aforementioned object, there is provided herein a method for manufacturing a cold-rolled dual-phase steel plate having a strength of at least 980 MPa, wherein a slab is directly transferred to be cold rolled after hot rolling, coiling, bundling, on-line thermal insulation, and then subjected to continuous annealing to obtain a cold rolled dual-phase steel plate; wherein a coiling temperature is controlled at 450° C. or higher; wherein the online thermal insulation means that each hot-rolled coil is covered with an independent and airtight thermal insulation enclosure within 30 minutes after unloading the coil, and transferred to be cold rolled; wherein a thermal insulation temperature of the hot-rolled coil in the thermal insulation enclosure is 450° C. or higher, and a thermal insulation time is less than 20 hours.

There is also provided herein a method for preventing edge cracking after cold rolling of a hot-rolled steel plate and reducing thickness fluctuation after the cold-rolling, wherein the method comprises covering a hot-rolled coil with an independent and airtight thermal insulation enclosure within 30 minutes after unloading the coil, and transferring it to a cold rolling step; wherein a thermal insulation temperature of the hot-rolled coil in the thermal insulation enclosure is between a coiling temperature and a bainite phase transformation temperature.

Preferably, the coiling temperature is controlled between 450° C. and the bainite phase transformation temperature.

Preferably, each hot-rolled coil is individually covered with an independent and airtight thermal insulation enclosure within 10 minutes after it is unloaded.

Preferably, when the thermal insulation temperature of the hot-rolled coil in the thermal insulation enclosure is required to be 550° C. or higher, a heating device is used to provide heat to an inside of the thermal insulation enclosure for maintaining the thermal insulation temperature.

Further, an electric heating device and a temperature sensor are provided in the thermal insulation enclosure.

Preferably, the thermal insulation enclosure has a composite structure, comprising: an outer protection layer, which is a high-strength steel plate; an intermediate layer, which is a thermal insulation material; and an inner layer, which is a high-temperature resistant stainless steel plate.

Preferably, the thermal insulation enclosure is a composite structure, comprising an inner radiation layer, an electric heating wire layer, an intermediate mesh cover, an intermediate thermal insulation layer, and an outer protection layer in order from inside to outside.

Preferably, temperature sensors are provided in the thermal insulation enclosure facing a surface and an end face of the steel coil respectively.

Further, the method further comprises a step of galvanization after continuous annealing to obtain a galvanized dual-phase steel plate.

DETAILED DESCRIPTION

Figure 1:
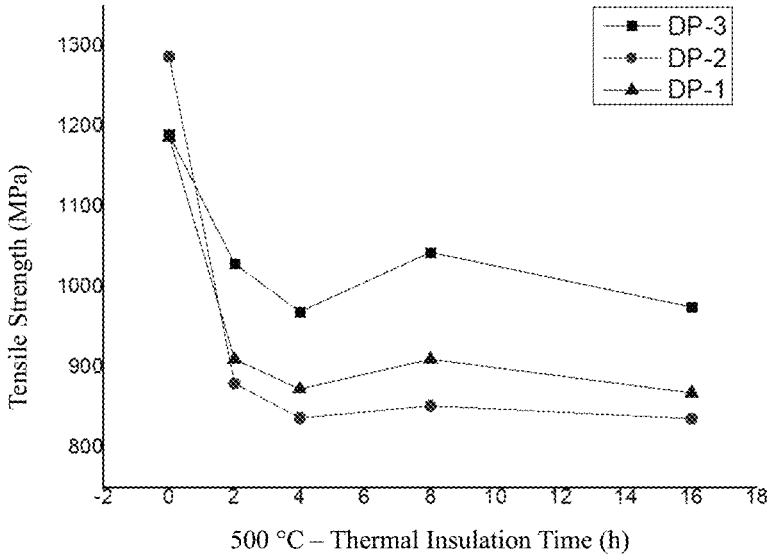
FIGS. 1-3 show the variation trends of the mechanical properties of three steel grades DP-1, DP-2, and DP-3 after being kept at 500° C., 550° C. and 600° C. for different periods of time.

It is intended herein to solve the problems of edge cracking after cold rolling, sharp thickness fluctuation after cold rolling and the like that occur in manufacturing by a thermal insulating process with or without a heat source after hot rolling and coiling, so as to obtain good cold-rolling manufacturability. To this end, according to the present disclosure, the coiling temperature is controlled to be 450° C. or higher; the thermal insulation temperature of the hot-rolled coil in the thermal insulation enclosure is controlled to be 450° C. or higher; and the thermal insulation time is controlled to be within 20 hours, for example, the thermal insulation time is 1-20 hours. In some embodiments, in the manufacturing method according to the present disclosure, after hot rolling, coiling, bundling and on-line thermal insulation, a slab is directly transferred to be cold rolled+continuously annealed or cold rolled+continuously annealed+galvanized to obtain a cold-rolled or galvanized dual-phase steel plate; wherein a coiling temperature is controlled at 450° C. or higher; wherein the online thermal insulation means that each hot-rolled coil is covered with an independent and airtight thermal insulation enclosure within 30 minutes after unloading the coil, and transferred to be cold rolled; wherein a thermal insulation temperature of the hot-rolled coil in the thermal insulation enclosure is 450° C. or higher, and a thermal insulation time is less than 20 hours.

The inventive method is particularly suitable for manufacturing a cold-rolled dual-phase steel plate having a tensile strength ≥980 MPa. Although the composition of the cold-rolled dual-phase steel plate having a tensile strength ≥980 MPa is not particularly limited, in some embodiments, such a steel plate generally comprises by weight percentage 0.05-0.2% C, preferably 0.08-0.17%; 0.1-1.0% Si, preferably 0.2-0.9%; 1.8-3.0% Mn, preferably 2.1-2.7%; 0.01-0.06% Al, preferably 0.01-0.04%; 0.01-0.08% Ti, preferably 0.01-0.05%; and a balance of Fe and unavoidable impurities. Optionally, such a steel plate may also comprise any one or more of B, Cr, Mo and Nb. When present, the content of B may be 0.0005-0.004%, preferably 0.001-0.003%; the content of Cr may be 0.10-0.80%, preferably 0.20-0.60%; the content of Mo may be 0.05-0.40%, preferably 0.15-0.30%; and the content of Nb may be 0.01-0.06%, preferably 0.02-0.05%. In some embodiments, such a steel plate comprises at least any two of B, Cr, Mo and Nb.

According to the present disclosure, in order to design the thermal insulation temperature, it's necessary to refer to the CCT curve of the component system, that is, to refer to the temperature and time at which each phase transformation begins. Taking a cold-rolled ultra-high-strength dual-phase steel mainly comprising C 0.12%, Si 0.25%, Mn 2.5%, Cr 0.6%, B 0.0025%, Al 0.03%, Nb 0.025% and Ti 0.025% and having a strength of 980 MPa or higher as an example, it can be seen from the CCT curve that the composition system will enter a soft phase region (ferrite phase region, pearlite phase region) and a hard phase region (bainite phase region, martensite phase region) respectively when cooled at different cooling rates after hot rolling. If the coiling and thermal insulation are performed at a temperature above the bainite transformation temperature (530° C.) of the dual-phase steel, there will be differentiation in the initial matrix structure across the coil. That is, the structure of the part that is rapidly cooled to 400° C. or lower is bainite+martensite; the structure of the central part that is kept at 530° C. or higher in a long time is pearlite and ferrite. It is very difficult to completely eliminate the differentiation in the structure of the matrix through thermal insulation, and the variation in mechanical properties will always be passed down.

Therefore, for the cold-rolled ultra-high-strength dual-phase steel, it is necessary to design a coiling temperature and a thermal insulation temperature that are lower than 530° C., so as to eliminate the differentiation in the initial matrix structure across the coil and make it completely be bainite+martensite.

Hence, according to the present disclosure, the coiling temperature is set to be equal to or lower than the bainite phase transformation temperature. If the coiling temperature is too low, the strength of the matrix structure will be further increased, so that a longer thermal insulation time will be needed for subsequent softening. Thus, according to the present disclosure, the coiling temperature is controlled to be 450° C. or higher. The thermal insulation temperature is set between the coiling temperature and the bainite phase transformation temperature.

According to the present disclosure, the thermal insulation time can be obtained by means of laboratory testing of cold-rolled ultra-high-strength dual-phase steels with different composition systems. For example, for cold-rolled dual-phase steel grades with different composition systems, laboratory thermal insulation experiments may be performed on hot-rolled steel plates to measure the change of the mechanical properties of the experimental samples after thermal insulation. Generally, at a selected thermal insulation temperature, the length of the thermal insulation time should be sufficient to make the maximum tensile strength of the steel coil be less than 1000 MPa at the end of the thermal insulation.

Three steel grades, DP-1, DP-2, and DP-3, are used as examples for illustration according to the present disclosure. The composition systems of the three steel grades are shown in Table 1.

TABLE 1

Compositions of three cold-rolled ultra-high-strength dual-phase steels

| Steel grade | C | Si | Mn | Cr | B | Al | Mo | Nb | Ti |
|---|---|---|---|---|---|---|---|---|---|
| DP-1 | 0.088 | 0.30 | 2.25 | 0.55 | | 0.02 | 0.22 | | 0.020 |
| DP-2 | 0.120 | 0.25 | 2.50 | 0.60 | 0.0025 | 0.03 | | 0.025 | 0.025 |
| DP-3 | 0.085 | 0.45 | 2.20 | | 0.0020 | 0.03 | 0.20 | 0.040 | 0.050 |

Figure 2:
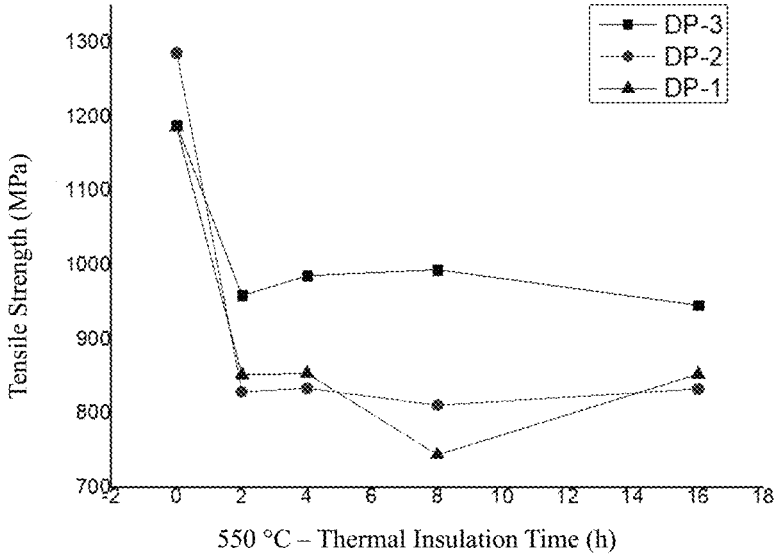
Figure 3:
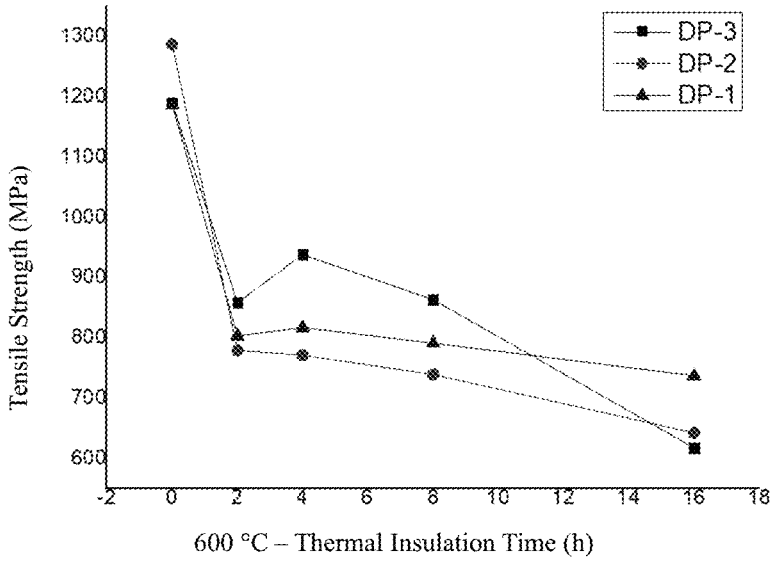

FIGS. 1-3 show the variation trends of the mechanical properties of three steel grades DP-1, DP-2, and DP-3 after being kept at 500° C., 550° C. and 600° C. for different periods of time.

Figure 4:
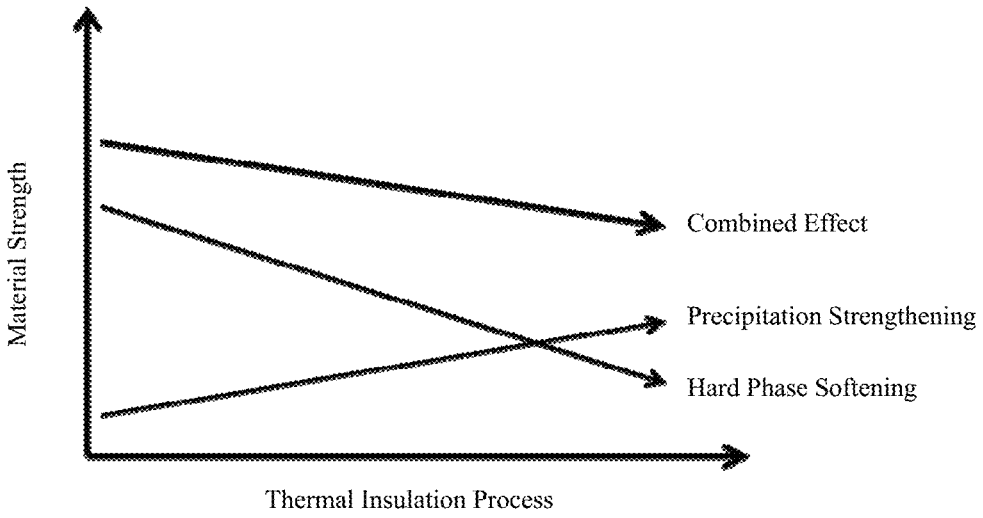
FIG. 4 shows schematically the decomposition softening and precipitation strengthening effect in the thermal insulation process.

The difference in the thermal insulation effect is attributed to the competition between the hard phase (martensite, bainite) decomposition softening and the precipitation strengthening of the carbides and nitrides of Nb and Ti in the matrix structure in the thermal insulation process. Different alloy composition systems exhibit different decomposition softening and precipitation strengthening effects under the same thermal insulation conditions. The combination of these two mechanisms determines the thermal insulation effect of steel grade, as shown by FIG. 4.

The hard phases in the DP-1, DP-2, and DP-3 structures are all decomposed during the thermal insulation process, and the strength tends to decrease for all the structures. In addition, the addition and proportion of an alloying element will also cause difference in the tempering resistance of the structure, so there may be difference in softening effect for the same structure under the same conditions of thermal insulation temperature and time.

On the other hand, due to the addition of alloying elements in the composition, carbides and nitrides of Nb and Ti precipitate during the tempering process, and the addition amounts and proportions of Nb, Ti, Mo, and Cr will influence the sizes of the carbides and nitrides of Nb and Ti, leading to difference in strengthening effect.

Figure 5:
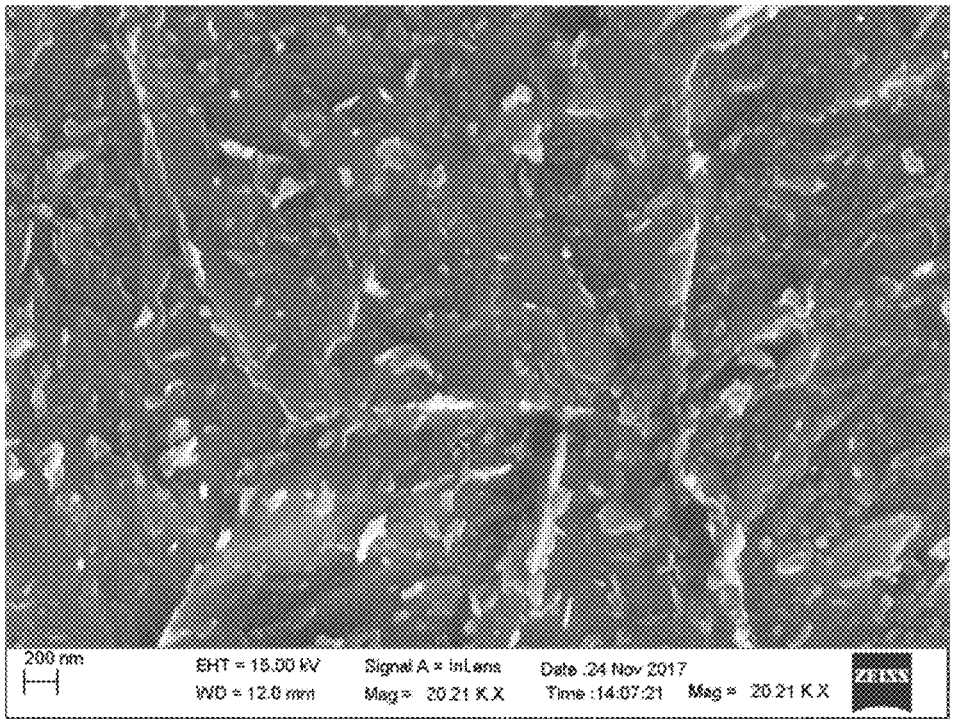
FIG. 5 shows observation on precipitates from DP-1 after thermal insulation for 8 h.
Figure 6:
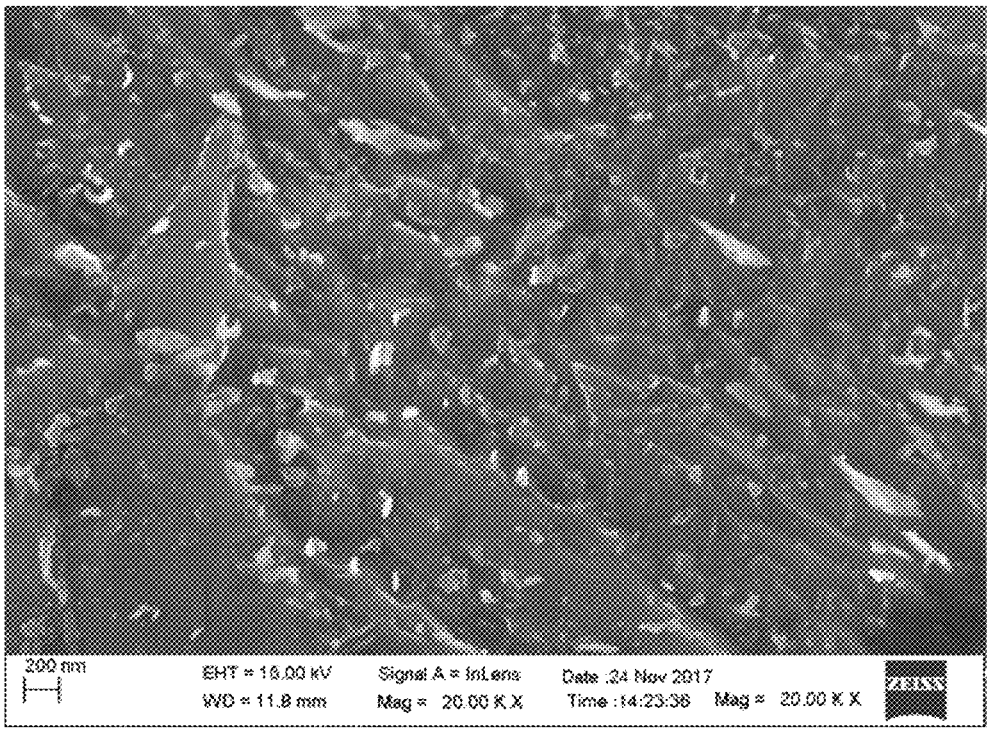
FIG. 6 shows observation on precipitates from DP-2 after thermal insulation for 8 h.
Figure 7:
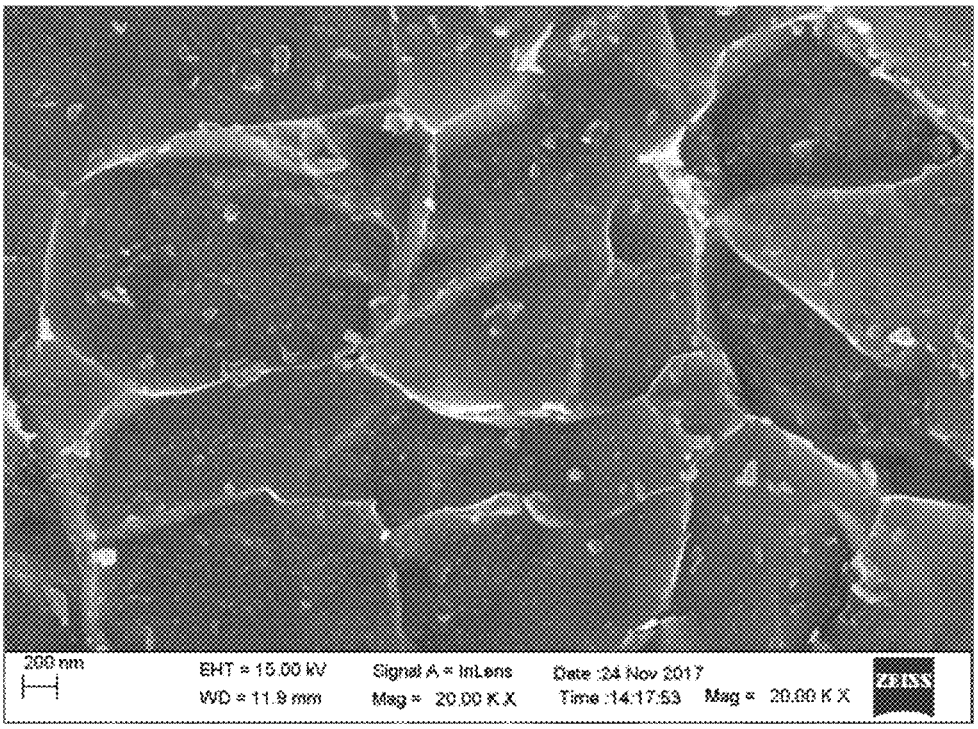
FIG. 7 shows observation on precipitates from DP-3 after thermal insulation for 8 h.

The scan photos of DP-1, DP-2, and DP-3 thermally insulated at 550° C. for 8 h are shown in FIGS. 5-7. As can be seen from the 20,000× scan photos, the sizes of carbides and nitrides of Nb and Ti in the DP-3 structure are extremely small, up to nanometer scale, which will produce a strengthening effect far greater than that of DP-1 and DP-2.

In summary, due to the combined effect of hard phase decomposition softening and precipitation strengthening, DP-3 has a higher strength than DP-1 and DP-2 after thermal insulation and tempering under the same conditions.

Therefore, according to the laboratory results, the reasonable thermal insulation time (under the reasonably designed thermal insulation temperature) for each of the three steel grades is shown in Table 2:

TABLE 2

| Steel grade | Thermal insulation process |
|---|---|
| DP-1 | 500° C., 5 h thermal insulation |
| DP-2 | 500° C., 5 h thermal insulation |
| DP-3 | 600° C., 10 h thermal insulation |

Figure 8:
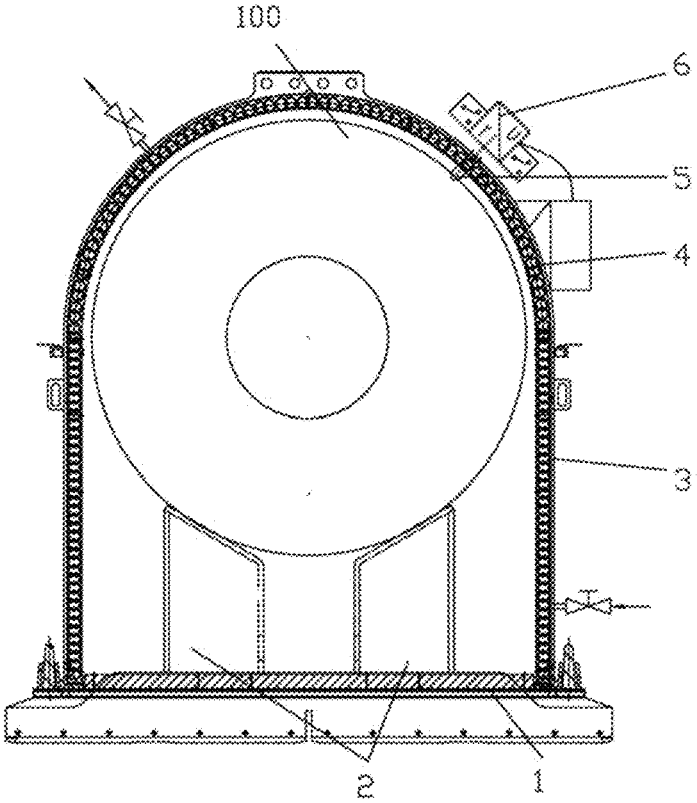
FIG. 8 is a schematic view showing the structure of the Examples according to the present disclosure.
Figure 9:
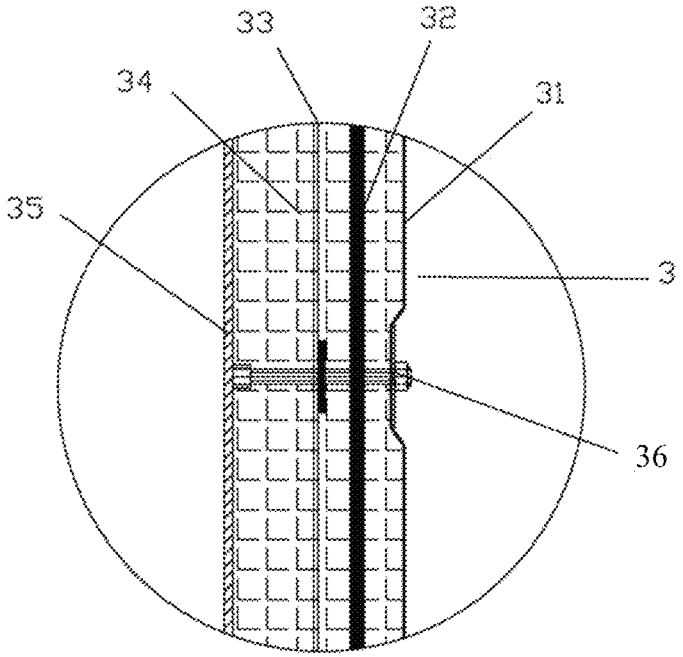
FIG. 9 is a cutaway view of a sidewall of the thermal insulation enclosure used in the Examples according to the present disclosure.

In the present disclosure, the purpose for applying the thermal insulation enclosure is to prevent radiation of heat to outside, and make use of the heat inside the steel coil to increase the surface temperature of the steel coil, so as to make the overall temperature of the steel coil uniform, thereby achieving the purpose of heat treating the steel coil. The present disclosure can be implemented using a thermal insulation enclosure device known in the art. An exemplary thermal insulation enclosure device is shown in FIGS. 8 and 9, comprising:

- a steel coil tray 1;
- a steel coil supporting prop 2 provided on the steel coil tray 1;
- a thermal insulation enclosure 3 provided outside the steel coil supporting prop 2, wherein the thermal insulation enclosure has an inner chamber having a volume larger than a combined volume of at least one steel coil 100+the steel coil supporting prop 2, and a lower end of the thermal insulation enclosure 3 is movably coupled to the steel coil tray 1.

The insulation enclosure device may further comprise:

- an electric heating device 4 provided on an inner sidewall of the thermal insulation enclosure 3;
- a temperature sensor 5 provided in the thermal insulation enclosure 3; and
- an information acquisition control module 6;
- wherein the electric heating device 4 and the temperature sensor 5 are electrically coupled to the information acquisition control module 6.

The electric heating device 4 may be an electric heating wire. The temperature sensor 5 may be a thermocouple. Preferably, the thermal insulation enclosure used according to the present disclosure not only enables use of residual heat of the hot-rolled steel coil to achieve slow cooling, but also allows for secondary heat treatment on some special steel materials to implement secondary tempering to improve the properties of the steel coil and refine grains.

Preferably, temperature sensors are provided in the thermal insulation enclosure 3 facing a surface and an end face of the steel coil 100 respectively.

Referring to FIG. 9, the thermal insulation enclosure 3 according to the present disclosure is a composite structure, comprising an inner radiation layer 31, an electric heating wire layer 32, an intermediate mesh cover 33, an intermediate thermal insulation layer 34, and an outer protection layer 35 in order from inside to outside; wherein the composite structure of the thermal insulation enclosure 3 is fixed with an anchor nail 36.

Presence or absence of the heating device depends on the thermal insulation temperature and time. For example, if the thermal insulation temperature is required to be higher than 550° C. but there is no heat source to provide heat and hold the temperature for a long time, the temperature in the thermal insulation enclosure will increase nonuniformly as the thermal insulation operation proceeds, which is not conducive to the uniformity of the coil strength. Therefore, when the thermal insulation temperature of the hot-rolled coil in the thermal insulation enclosure is required to be 550° C. or higher, a heating device should be used to provide heat to the inside of the thermal insulation enclosure for maintaining the thermal insulation temperature.

Generally, the hot-rolled coil covered with the thermal insulation enclosure may be transferred to the cold-rolling step through a steel coil transport chain or a moving trolley.

In the inventive method, after hot rolling, the steel coil is thermally insulated in the thermal insulation enclosure in order to prevent radiation of heat to outside, and make use of the heat inside the steel coil to increase the surface temperature of the steel coil, so as to make the overall temperature of the steel coil uniform, thereby achieving the purpose of heat treating the steel coil in an environmentally friendly, energy-saving, convenient and efficient way.

Based on the phase transformation temperature and phase transformation time at different cooling rates after hot rolling and coiling, the thermal insulation temperature is designed reasonably to ensure that the variation of the initial matrix structure throughout the coil is small.

Different composition systems have different softening effects at a certain thermal insulation temperature and a certain thermal insulation time, and the results of the properties measured in laboratory experiments will be used as a reasonable basis for designing the thermal insulation time.

Based on the results of laboratory thermal insulation experiments, control of the tensile strength of a hot-rolled steel coil to be less than 1000 MPa is helpful to ensure the cold-rolling manufacturability, and avoid defects such as edge cracking after cold rolling and sharp thickness fluctuation after cold rolling.

Compared with the prior art, a cold-rolled or galvanized dual-phase steel plate with high cold-rolling manufacturability and a tensile strength of greater than 980 MPa is obtained by reasonably designing the thermal insulation temperature and thermal insulation time according to the present disclosure. The tensile strength is less than 1000 MPa after the hot-rolled coil is thermally insulated in the intermediate process. The steel plate has good cold-rolling manufacturability and can avoid defects such as edge cracking after cold rolling and sharp thickness fluctuation after cold rolling.

DETAILED DESCRIPTION

The cold-rolled dual-phase steel plates at the level of 980 MPa or higher in the Examples and Comparative Examples were prepared according to the compositions listed in Table 3. After hot rolling, coiling, bundling, and on-line thermal insulation, the slabs were directly transferred to be cold-rolled+continuously annealed to obtain cold-rolled dual-phase steel plates.

The coiling temperatures are shown in Table 4. Within 30 minutes after unloading, each hot-rolled coil was covered with an independent and airtight insulation enclosure, and the hot-rolled coil covered with the insulation enclosure was transferred by a coil transport chain or a moving trolley to be cold rolled. The thermal insulation temperature and thermal insulation time for each hot-rolled coil in the thermal insulation enclosure is shown in Table 4. When the thermal insulation temperature of the hot-rolled coil in the thermal insulation enclosure is required to be 550° C. or higher, a heating device is used to provide heat to an inside of the thermal insulation enclosure for maintaining the thermal insulation temperature.

TABLE 3

Compositions of Examples and Comparative Examples (unit: weight percent)

| No. | C | Si | Mn | Al | B | Cr | Mo | Nb | Ti |
|---|---|---|---|---|---|---|---|---|---|
| Ex. 1 | 0.088 | 0.30 | 2.25 | 0.02 | | 0.55 | 0.22 | | 0.02 |
| Ex. 2 | 0.120 | 0.25 | 2.50 | 0.03 | 0.0025 | 0.60 | | 0.025 | 0.025 |
| Ex. 3 | 0.085 | 0.45 | 2.20 | 0.03 | 0.0020 | | 0.20 | 0.040 | 0.05 |
| Ex. 4 | 0.088 | 0.30 | 2.25 | 0.02 | | 0.55 | 0.22 | | 0.02 |
| Ex. 5 | 0.120 | 0.25 | 2.50 | 0.03 | 0.0025 | 0.60 | | 0.025 | 0.025 |
| Ex. 6 | 0.085 | 0.45 | 2.20 | 0.03 | 0.0020 | | 0.20 | 0.040 | 0.05 |
| Comp. Ex. 7 | 0.088 | 0.30 | 2.25 | 0.02 | | 0.55 | 0.22 | | 0.02 |
| Comp. Ex. 8 | 0.120 | 0.25 | 2.50 | 0.03 | 0.0025 | 0.60 | | 0.025 | 0.025 |
| Comp. Ex. 9 | 0.085 | 0.45 | 2.20 | 0.03 | 0.0020 | | 0.20 | 0.040 | 0.05 |

TABLE 4

Post-hot-rolling thermal insulation processes in Examples and Comparative Examples

| Steel grade | Thermal insulation temperature (Coiling temperature) | Thermal insulation time | Using heating device or not | Maximum tensile strength of hot-rolled steel coil (MPa) |
|---|---|---|---|---|
| Ex. 1 | 500° C. | 5 h | No | 805 |
| Ex. 2 | 500° C. | 5 h | No | 956 |
| Ex. 3 | 600° C. | 8 h | Yes | 905 |
| Ex. 4 | 500° C. | 10 h | No | 756 |
| Ex. 5 | 500° C. | 10 h | No | 923 |
| Ex. 6 | 600° C. | 15 h | Yes | 845 |
| Comp. Ex. 7 | 600° C. | 5 h | No | 798 |
| Comp. Ex. 8 | 600° C. | 5 h | No | 942 |

TABLE 4-continued

Post-hot-rolling thermal insulation processes in Examples and Comparative Examples

| Steel grade | Thermal insulation temperature (Coiling temperature) | Thermal insulation time | Using heating device or not | Maximum tensile strength of hot-rolled steel coil (MPa) |
|---|---|---|---|---|
| Comp. Ex. 9 | 600° C. | 10 h | No | 1034 |

TABLE 5

Cold-rolling manufacturability indexes of Examples and Comparative Examples

| Steel grade | Edge cracking after rolling | Thickness fluctuation after cold rolling | Final tensile strength of continuously annealed steel plate (MPa) |
|---|---|---|---|
| Ex. 1 | No | 20 μm | 1034 |
| Ex. 2 | No | 25 μm | 1234 |
| Ex. 3 | No | 18 μm | 1021 |
| Ex. 4 | No | 19 μm | 998 |
| Ex. 5 | No | 21 μm | 1254 |
| Ex. 6 | No | 15 μm | 1003 |
| Comp. Ex. 7 | No | 70 μm | 1002 |
| Comp. Ex. 8 | Yes | 70 μm | 1198 |
| Comp. Ex. 9 | No | 90 μm | 997 |

Referring to Table 4 and Table 5, the thermal insulation temperatures in Examples 1, 2, 4, and 5 were reasonably designed, and differentiation in the initial matrix structure of the whole coil was prevented, i.e. the structure was completely bainite+martensite. The cold rolling manufacturability was good. In Comparative Examples 7 and 8, the thermal insulation temperatures were rather high, and the initial matrix structure of the whole coil differentiated. The structure of the part that was rapidly cooled to 400° C. or lower was bainite+martensite, while the structure of the central part that was kept at 550° C. or higher in a long time was pearlite and ferrite. The cold-rolling manufacturability became poor, and sharp edge cracking and thickness fluctuation after cold rolling occurred. Control of the tensile strength of a hot-rolled steel coil to be less than 1000 MPa is helpful to ensure the cold-rolling manufacturability, and avoid defects such as edge cracking after cold rolling and sharp thickness fluctuation after cold rolling, as shown by Examples 3 and 6. Comparative Example 9 could not guarantee that the tensile strength was uniformly reduced to 1000 MPa or lower across the full length, and the thickness fluctuated sharply after cold rolling.

The invention claimed is:

1. A method for manufacturing a cold-rolled dual-phase steel plate having a strength of at least 980 MPa, wherein a slab is directly transferred to be cold rolled after hot rolling, coiling, bundling, and on-line thermal insulation, and then subjected to continuous annealing to obtain a cold rolled dual-phase steel plate; wherein a coiling temperature is controlled at 450° C. or higher; wherein the online thermal insulation means that each hot-rolled coil is covered with an independent and airtight thermal insulation enclosure within 30 minutes after unloading the coil, and transferred to be cold rolled; wherein a thermal insulation temperature of the hot-rolled coil in the thermal insulation enclosure is 450° C. or higher, and a thermal insulation time is within 20 hours; wherein an electric heating device and a temperature sensor are provided in the thermal insulation enclosure.

2. The method for manufacturing a cold-rolled dual-phase steel plate having a strength of at least 980 MPa according to claim 1, wherein the coiling temperature is controlled between 450° C. and a bainite phase transformation temperature.

3. The method for manufacturing a cold-rolled dual-phase steel plate having a strength of at least 980 MPa according to claim 1, wherein said each hot-rolled coil is individually covered with an independent and airtight thermal insulation enclosure within 10 minutes after it is unloaded.

4. The method for manufacturing a cold-rolled dual-phase steel plate having a strength of at least 980 MPa according to claim 1, wherein, when the thermal insulation temperature of the hot-rolled coil in the thermal insulation enclosure is required to be 550° C. or higher, a heating device is used to provide heat to an inside of the thermal insulation enclosure for maintaining the thermal insulation temperature.

5. The method for manufacturing a cold-rolled dual-phase steel plate having a strength of at least 980 MPa according to claim 1, wherein temperature sensors are provided in the thermal insulation enclosure facing a surface and an end face of the steel coil respectively.

6. The method for manufacturing a cold-rolled dual-phase steel plate having a strength of at least 980 MPa according to claim 1, wherein the thermal insulation enclosure is a composite structure comprising: an outer protection layer, which is a steel plate; an intermediate layer, which is a thermal insulation material; and an inner layer, which is a stainless steel plate; or wherein the thermal insulation enclosure is a composite structure comprising an inner radiation layer, an electric heating wire layer, an intermediate mesh cover, an intermediate thermal insulation layer, and an outer protection layer in order from inside to outside.

7. The method for manufacturing a cold-rolled dual-phase steel plate having a strength of at least 980 MPa according to claim 1, wherein the steel plate comprises 0.05-0.2% C, 0.1-1.0% Si, 1.8-3.0% Mn, 0.01-0.06% Al, and 0.01-0.08% Ti and a balance of Fe and unavoidable impurities.

8. A method for manufacturing a cold-rolled galvanized dual-phase steel plate having a strength of at least 980 MPa, wherein the method comprises a step of galvanization after a cold-rolled dual-phase steel plate is manufactured by the method of claim 1.

9. The method for manufacturing a cold-rolled dual-phase steel plate having a strength of at least 980 MPa according to claim 1, wherein said each hot-rolled coil is individually covered with an independent and airtight thermal insulation enclosure within 10 minutes after it is unloaded;

wherein an electric heating device and temperature sensors are provided in the thermal insulation enclosure, wherein the temperature sensors are provided in the thermal insulation enclosure facing a surface and an end face of the steel coil respectively, and when the thermal insulation temperature of the hot-rolled coil in the thermal insulation enclosure is required to be 550° C. or higher, the electric heating device is used to provide heat to an inside of the thermal insulation enclosure for maintaining the thermal insulation temperature; and wherein the thermal insulation enclosure is a composite structure comprising: an outer protection layer, which is a steel plate; an intermediate layer, which is a thermal insulation material; and an inner layer, which is a stainless steel plate; or the thermal insulation enclosure is a composite structure comprising an inner radiation layer, an electric heating wire layer, an intermediate mesh cover, an intermediate thermal insulation layer, and an outer protection layer in order from inside to outside.

10. The method for manufacturing a cold-rolled dual-phase steel plate having a strength of at least 980 MPa according to claim 9, wherein the steel plate comprises 0.05-0.2% C, 0.1-1.0% Si, 1.8-3.0% Mn, 0.01-0.06% Al, and 0.01-0.08% Ti and a balance of Fe and unavoidable impurities.

11. The method for manufacturing a cold-rolled galvanized dual-phase steel plate having a strength of at least 980 MPa according to claim 8, wherein in the method for manufacturing the cold-rolled dual-phase steel plate, said each hot-rolled coil is individually covered with an independent and airtight thermal insulation enclosure within 10 minutes after it is unloaded;

an electric heating device and temperature sensors are provided in the thermal insulation enclosure, wherein the temperature sensors are provided in the thermal insulation enclosure facing a surface and an end face of the steel coil respectively, and when the thermal insulation temperature of the hot-rolled coil in the thermal insulation enclosure is required to be 550° C. or higher, the electric heating device is used to provide heat to an inside of the thermal insulation enclosure for maintaining the thermal insulation temperature; and the thermal insulation enclosure is a composite structure comprising: an outer protection layer, which is a steel plate; an intermediate layer, which is a thermal insulation material; and an inner layer, which is a stainless steel plate; or the thermal insulation enclosure is a composite structure, comprising an inner radiation layer, an electric heating wire layer, an intermediate mesh cover, an intermediate thermal insulation layer, and an outer protection layer in order from inside to outside.

12. The method for manufacturing a cold-rolled dual-phase steel plate having a strength of at least 980 MPa according to claim 7, wherein the steel plate further comprises at least one or at least two of 0.0005-0.004% B, 0.10-0.80% Cr, 0.05-0.40% Mo, 0.01-0.06% Nb; and a balance of Fe and unavoidable impurities.

13. The method for manufacturing a cold-rolled dual-phase steel plate having a strength of at least 980 MPa according to claim 10, wherein the steel plate further comprises at least one or at least two of 0.0005-0.004% B, 0.10-0.80% Cr, 0.05-0.40% Mo, 0.01-0.06% Nb; and a balance of Fe and unavoidable impurities.

* * * * *